US009861256B2

(12) United States Patent
Lima et al.

(10) Patent No.: US 9,861,256 B2
(45) Date of Patent: Jan. 9, 2018

(54) SYSTEM FOR SUPPLYING WASHING INPUTS AND WASHING MACHINE PROVIDED WITH SYSTEM FOR SUPPLYING WASHING INPUTS

(75) Inventors: Leandro Souza Lima, Nova Odessa (BR); Denilson Femandes de Oliveira, Rio Claro (BR)

(73) Assignee: Whirlpool S.A., Sao Paulo (BR)

( * ) Notice: Subject to any disclaimer, the term of this patent is extended or adjusted under 35 U.S.C. 154(b) by 347 days.

(21) Appl. No.: 14/342,635

(22) PCT Filed: Sep. 3, 2012

(86) PCT No.: PCT/BR2012/000333
§ 371 (c)(1),
(2), (4) Date: Aug. 18, 2014

(87) PCT Pub. No.: WO2013/033799
PCT Pub. Date: Mar. 14, 2013

(65) Prior Publication Data

US 2014/0352821 A1 Dec. 4, 2014

(30) Foreign Application Priority Data

Sep. 5, 2011 (BR) ..... 1103942

(51) Int. Cl.
*A47L 15/44* (2006.01)
*D06F 39/02* (2006.01)

(52) U.S. Cl.
CPC ..... *A47L 15/4418* (2013.01); *A47L 15/44* (2013.01); *D06F 39/022* (2013.01); *D06F 39/028* (2013.01); *Y10T 137/86187* (2015.04)

(58) Field of Classification Search
None
See application file for complete search history.

(56) References Cited

U.S. PATENT DOCUMENTS 6,227,012 B1 * 5/2001 Borroni ..... D06F 39/02 134/93
2010/0000264 A1 * 1/2010 Luckman ..... D06F 33/02 68/4

FOREIGN PATENT DOCUMENTS

DE 10150878 A1 * 7/2002 ..... D06F 39/028
EP 2331739 A1 6/2011
(Continued)

OTHER PUBLICATIONS

International Search Report for International Application No. PCT/BR2012/000333 dated Mar. 18, 2013. 3 pages.

*Primary Examiner* — Michael E Barr
*Assistant Examiner* — Cristi J Tate-Sims
(74) *Attorney, Agent, or Firm* — Harrington & Smith

(57) ABSTRACT

The present invention relates to a system for supplying washing inputs comprised by at least one hydraulic circuit comprising at least one water inlet pipe (2), at least one reservoir (3) of inputs and at least one inputs outlet pipe (4). It is further provided at least one water spreader (5) associated with at least one water inlet pipe (2) and at least one containment structure (6) associated with at least one inputs outlet pipe (4). According to the present invention, at least one gap (V1) is arranged between the front wall (31) of at least one reservoir (3) of inputs and the front wall (61) of at least one containment structure (6), at least one spraying means (51) of at least one water spreader (5) is directed to at least one gap (V1) arranged between the front wall (31) of at least one reservoir (3) of inputs and the front wall (61) of at least one containment structure (6), and it is generated at least one flow of inputs between the front wall (31) of at least one reservoir (3) of inputs and the front wall (61) of at least one containment structure (6).

19 Claims, 2 Drawing Sheets

(56) References Cited

FOREIGN PATENT DOCUMENTS

| | | | | | |
|---|---|---|---|---|---|
| EP | 2 492 387 | A1 | | 8/2012 | |
| GB | 1130201 | A | * | 10/1968 | ..... A47L 15/44 |

* cited by examiner

SYSTEM FOR SUPPLYING WASHING INPUTS AND WASHING MACHINE PROVIDED WITH SYSTEM FOR SUPPLYING WASHING INPUTS

RELATED APPLICATIONS

The subject application is a U.S. National Stage Application of International Application No. PCT/BR2012/000333, filed on 3 Sep. 2012, which claims the priority of Brazil Patent Application No. PI1103942-6, filed on 5 Sep. 2011, the contents of which are herein incorporated by reference in its entirety.

FIELD OF THE INVENTION

The present invention relates to a system for supplying washing inputs, in particular an optimized system for supplying liquid inputs (diluted from solid or liquid inputs) used in automatic washing processes.

The present invention also relates to a washing machine provided with at least one system for supplying washing inputs.

BACKGROUND OF THE INVENTION

It is common knowledge that washing processes generally use washing inputs, which are intended to assist in the removal of pollutant particles impregnated in the objects to be washed.

The current state of the art comprises a multitude of washing inputs, and these can basically be defined as chemical compounds capable of triggering at least one chemical reaction when in contact with water and/or pollutant particles. In this regard, the current state of the art provides cleaning inputs in the solid, liquid and pasty state. Conventionally, these cleaning inputs are soluble, diluted with water and/or liquids also used in washing processes.

In automatic washing processes, the washing inputs are normally diluted in water and placed in a washing "environment".

In the case of washing machines—both in washing machines as in dishwashing machines—cleaning inputs are normally diluted in water and placed in a washing chamber and/or tank.

Based on this context, note also that the current state of the art provides a wide variety of systems for supplying washing inputs. Most of the existing solutions are fundamentally applicable at washing machines capable of performing automatic washing processes.

In general, these systems for supplying washing inputs are fundamentally comprised of at least one storage reservoir of inputs undiluted disposed in at least one extent of a hydraulic circuit, and such hydraulic circuit has at least one water inlet pipe and one outlet pipe for diluted inputs.

Also in this context, it is known by the experts skilled in the art than most systems for supplying washing inputs existing has an dilution stage of washing inputs based on "overflow", where the water (or washing liquid) of the inlet pipe is dedicatedly directed to undiluted inputs reservoir, causing said reservoir to be fully filled and start "overflowing" properly diluted washing inputs. In such cases, the outlet pipe of diluted inputs is arranged below the reservoir of inputs so as to convey the diluted inputs to a washing chamber and/or tank.

Alternatively, a water spreader can still be arranged at the final "end" of the water inlet pipe. In this case, the flow of inlet water flow is split into small water jets, which are directed to at least one reservoir. The great advantage related to the use of water spreaders consists in the fact that more than one reservoir (for a system for supplying washing inputs) can be filled with water from a single water inlet pipe.

Still alternatively, an inclined tray may be disposed in the "initial" end of outlet pipe of diluted inputs. In this case, the entire flow of "overflow" can be firstly accumulated in a single point, and then drained by the outlet pipe itself.

An example of water spreader is described in U.S. Pat. No. 7,934,403. This water spreader is essentially composed of a two-part body which, when assembled, defines a chamber provided with hydraulic sub-circuits, each hydraulic sub-circuit also presents multiple spray orifices. In this case, all spray orifices are dedicatedly directed to at least one reservoir on undiluted inputs.

Through the document U.S. Pat. No. 7,934,403 it is also possible to notice another common feature in systems for supplying washing inputs belonging to the state of the art. This common feature it is the location/provision of a system for supplying washing inputs in a washing machine.

Thus, such systems are commonly arranged on the front panel of the washing machines. In particular, the reservoir of undiluted inputs is integrated to a displaceable body which can be removed and introduced into the washing machine, similar to a drawer. This fundamental construction allows the reservoir of undiluted inputs to be replenished in a simplified manner. In this respect, it is also noticed that the water inlet pipes and outlet pipes of diluted inputs are fixedly arranged inside the washing machine, next to the reservoir of undiluted inputs.

According to the functional principle of dilution of the inputs (overflow) mentioned above, it is noticed that the current reservoirs of undiluted inputs are shaped so as to avoid any type of "frontal overflow", that is, the current reservoirs of undiluted inputs do not have a constructiveness that benefits only the "overflow" by its lateral and posterior regions.

This feature is mainly occurs due to the fact that the frontal region of the reservoir of undiluted inputs lies next to the front panel of the washing machine, and any "frontal overflows" can cause water leakage on the front panel of the washing machine, where there are arranged electronic components.

If, on the one hand, this characteristic is responsible for preventing eventual accidents related to hydraulic leak in a circuit/electronic component, on the other hand, this same feature is responsible for oversizing of the inclined tray and of the outlet pipe of diluted inputs, since these elements must be able to promote the flow of the "overflow" into a flow rate that its higher than the flow rate of inlet water.

An alternative example of system for supplying washing inputs is described in U.S. Pat. No. 5,375,438. According to this document, the water inlet pipe is directed to the reservoir of undiluted input and to the output pipe of diluted inputs. In this case, besides the existence of a conventional hydraulic circuit (reservoir disposed between the inlet pipe and outlet pipe), it is also provided a "by-pass" hydraulic circuit where the inlet and outlet pipes define between them a direct connection.

Anyway, the system for supplying washing inputs described in U.S. Pat. No. 5,375,438 is unable to remedy the currently existing disadvantages (and exemplified in the document U.S. Pat. No. 7,934,403). Thus, it becomes evident to observe the need to create a system for supplying washing inputs free of the negative aspects related hitherto.

OBJECTIVES OF THE INVENTION

Thus, it is an objective of the present invention to provide a system for supplying washing inputs capable of "frontal overflow" free of the problems previously explained. Thus, it is also one of the objectives of the present invention that the system for supplying washing inputs be capable of by functional miniaturization (allowing "frontal overflow").

It is another objective of the present invention to provide a system for supplying washing inputs whose possibility of leaks is substantially minimized.

It is also one objective of this invention to provide a system for supplying washing inputs with greater flow of diluted inputs (without the operational dimensions being proportionally increased).

It is another objective of this invention to provide a washing machine provided with at least one system for supplying washing inputs.

SUMMARY OF THE INVENTION

These and other objectives of the invention now disclosed herein are fully achieved by means of a system for supplying washing inputs now proposed.

The system comprises at least one composed hydraulic circuit associated with at least one pipe by at least one water inlet pipe, by at least one reservoir of inputs, and by at least one outlet pipe of diluted inputs. It is further provided at least one spreader of water inlet. It is also provided at least one containment structure associated with the at least one outlet pipe of diluted inputs. In this regard, at least one reservoir of inputs is arranged within the perimeter of at least one containment structure.

Apart from these aspects, it is noted that the system in question comprises at least one gap disposed between the front wall of the at least one reservoir of inputs and the front wall of the at least one containment structure. It is also provided at least one sprayer means of the at least one water spreader directed to at least one gap disposed between the front wall of the at least one reservoir of inputs and the front wall of the at least one containment structure. It is thus generated at least one flow of inputs existing between the front wall of the at least one reservoir of inputs and the front wall of the at least one containment structure.

Therefore, means are defined to accelerate the flow rate between the inputs existing between the front wall of the at least one reservoir of inputs and the front wall of the at least one containment structure Optionally, at least one water spreader provides at least one spray means directed toward the at least one gap disposed between the rear wall of the at least one reservoir of inputs and the rear wall of the at least one containment structure. In this case, it generates at least one flow of inputs between the rear wall of the at least one reservoir of inputs and the rear wall of the at least one containment structure.

Also optionally, at least one water spreader provides at least one spray means directed toward at least one gap disposed between at least one sidewall of at least one reservoir of inputs and at least one sidewall of at least one containment structure. Also in this case, it generates under a flow of inputs between at least one sidewall of at least one reservoir of inputs and at least one sidewall of at least one containment structure.

Preferably, at least one reservoir of inputs comprises a body of inputs independent and able to be housed inside the perimeter of the containment structure. Specifically, at least one reservoir of inputs is able to be housed inside a compartmentalized recess defined within the perimeter of a containment structure.

According to the concepts of the subject invention, the system for supplying washing inputs proposed herein provides simultaneously at least two flow of inputs, wherein at least one of the input flows have its flow are accelerated through the water sprayed by at least one spray means directed to the at least one gap.

The washing machine provided with the system for supplying washing inputs comprises a clothes washing machine or a dishwashing machine.

BRIEF DESCRIPTION OF THE FIGURES

The present invention will be detailed in details based on the figures listed below, which.

DETAILED DESCRIPTION OF THE INVENTION

Figure 1:
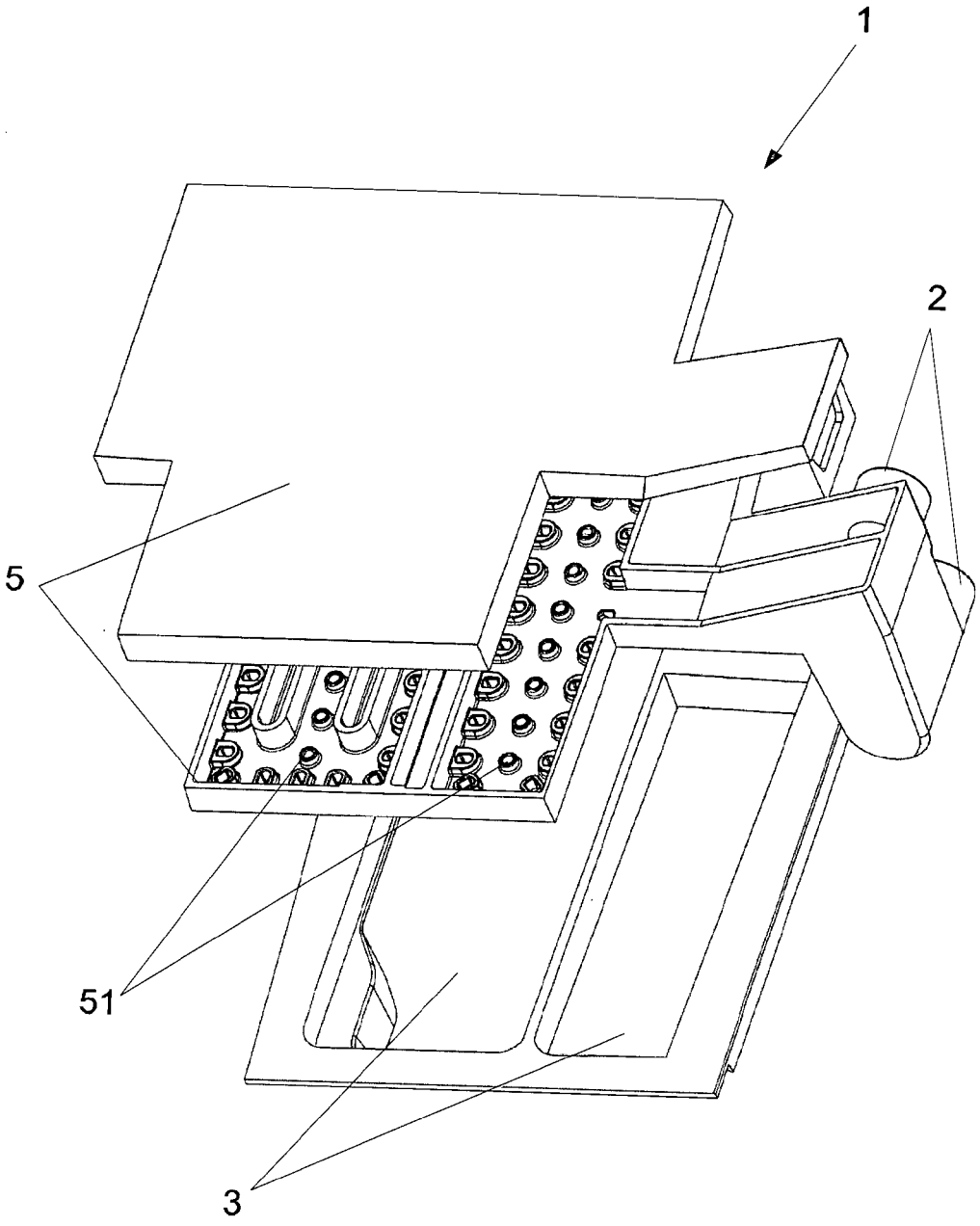
FIG. 1 illustrates, in schematic form, the system for supplying washing inputs, seen in exploded perspective.

In accordance with the concepts and objectives of the present invention, there is disclosed a system for supplying washing inputs (hereinafter referred to simply as system 1) responsible for supplying washing inputs to one washing chamber and/or tank (not shown). Fundamentally, the system 1 is substantially more efficient than counterpart systems belonging to the current state of the art by the fact of providing a flow of fluid (in this case preferably diluted washing inputs) of greater flow without the proportions of components comprising the system 1 also having to be increased.

In general, the system 1 basically consists of a hydraulic circuit comprising at least one water inlet pipe 2, at least one inputs reservoir 3, and at least one inputs outlet pipe 4. It is provided also a water spreader 5 associated with the water inlet pipe 2, and a containment structure 6 associated with the inputs outlet pipe 4. Therefore, the functional concept of the system 1 comprises subjecting a quantity of water to one portion of inputs in order to dilute it and lead it into the washing chamber and/or tank.

Figure 2:
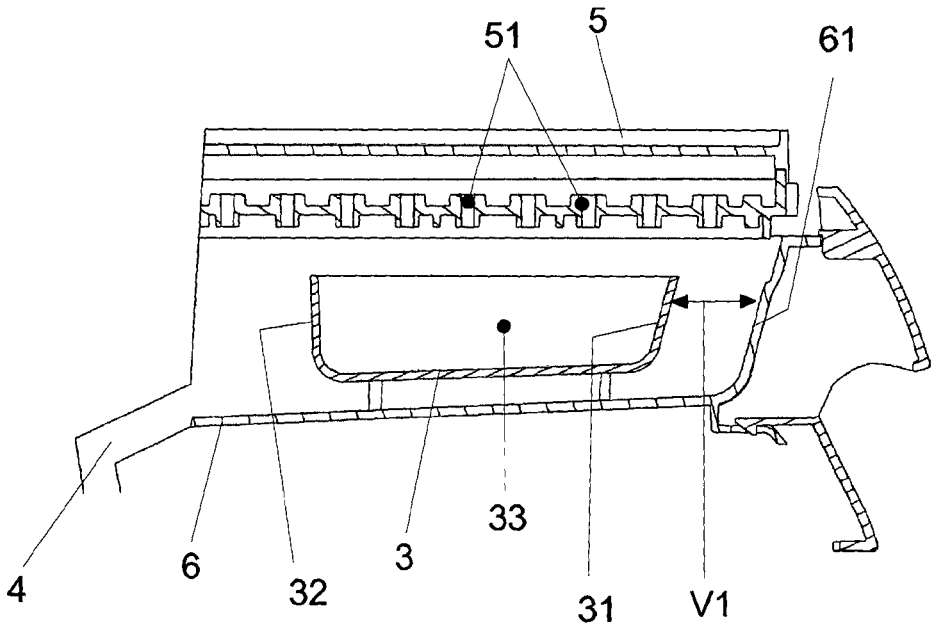
FIG. 2 illustrates, also in schematic form, a side cut of the system for supplying washing inputs.
Figure 3:
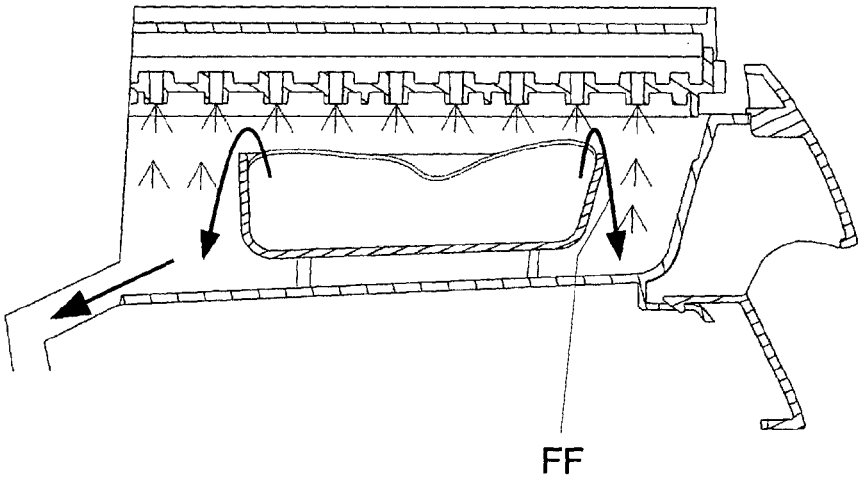
FIG. 3 illustrates the cutting of FIG. 3 with schematic indication of the flows of fluid.

FIGS. 1, 2, 3 and 4 illustrate a preferred embodiment of the system 1. According to these figures, it is noticed that the aforementioned preferred embodiment is especially suitable for a washing machine (not shown), however, this characterization is not exhaustive, but only illustrative.

Therefore, the water inlet pipe 2 comprises a preferably flexible pipe and arranged within the washing machine (not shown). One of the ends of the pipe 2 is connected to a water source (not shown) which may comprise a conventional hydraulic system, or besides that, a point of feedback of the washing machine itself. The other end of the pipe 2 is associated with a spreader 5.

The reservoir 3 comprises a monobloc body formed by a front wall 31, by a rear wall 32, by two side walls and a bottom 33. According to the preferred embodiment in question. Inferiorly, the reservoir 3 also provides at least one support structure.

The reservoir 3 is housed inside the containment structure 6, especially within a compartmentalized recess, which is defined especially for receipt of said reservoir 3. In fact, the containment structure 6 comprises the "drawer" capable of being inserted and withdrawn from inside the washing machine (not shown). In this context, the containment structure 6 provides the association with the inputs outlet pipe 4.

The aforementioned inputs outlet pipe 4 has, then, one of its ends attached to the containment structure 6 (in particular, a through hole and not illustrated existing in said containment structure 6) with its other end associated (not necessarily connected to) to a washing chamber and/or tank (not shown).

The spreader 5 comprises a device provided with multiple spraying means 51. Such spraying means may be formed by simple through holes, or by spray nozzles. In general, a spraying means 5 is a water escaping means, particularly the water coming from the water inlet pipe 2.

The containment structure 6, as previously mentioned, comprises the "drawer" where the components of the system 1 are assembled and/or arranged. Therefore, the aforementioned containment structure 6 is essentially formed by a front wall 61, by a rear wall, and by side and/or intermediate walls. The containment structure 6 also provides at least one compartmentalized recess dedicated to receiving a reservoir 3.

The descriptions and comments regarding the preferred embodiment aim to contextualize the inventive character in the system 1, which stands for the aspects listed below.

According to the present invention, the reservoir 3 is housed inside the containment structure 6 (or within the compartmentalized recess of the retaining structure 6) so that a gap V1 is maintained arranged between the front wall 31 of the reservoir 3 and the front wall 61 of the containment structure 6. The existence of the gap V1 allows the existence of "front" flow of inputs FF.

Another item of fundamental importance refers to the inventive character of the invention in question consists in the fact that at least one spray means 51 of the water spreader 5 is directed to the gap V1 arranged between the front wall 31 of the reservoir 3 and the front wall 61 of structure containment 6. This spraying means 51 directed to the gap V1 will finally settle a means for accelerating the flow rate of the "frontal" flow of the inputs FF, since the pressure of this spraying means 51 ends up "pushing" the "frontal" flow of inputs FF, preventing it from leaking out of the containment structure 6.

Functional assays have proven that this "form" of acceleration of flow, under the conditions disclosed and exemplified herein, eventually reduce the possibility of leakage, therefore, it becomes feasible to establish a "frontal overflow" at components with conventional dimensions.

Optionally, the concept of accelerating the flow of fluid disclosed herein may also be implemented in "side and rear overflows", wherein for this end, there should be provided with spraying means specifically directed to other gaps existing between the walls of the reservoir 3 and the walls 6 of the containment structure.

The system 1 detailed herein, besides being integrated into a clothes washing machine, can also be integrated into a dishwashing machine.

Having described an example of preferred embodiment of the present invention, it should be understood that the scope of it covers other possible variations, being only limited by the contents of the claims, including therein the possible equivalent means.

The invention claimed is:

1. A system for supplying washing inputs, comprising:

at least one hydraulic circuit comprising at least one water inlet pipe, at least one reservoir of inputs and at least one inputs outlet pipe;

at least one water spreader associated with the at least one water inlet pipe;

at least one containment structure associated with the at least one inputs outlet pipe, and the at least one reservoir of inputs arranged within a perimeter of the at least one containment structure;

a first gap arranged between a front wall of the at least one reservoir of inputs and a front wall of the at least one containment structure;

at least one spraying means of the at least one water spreader directed to the first gap arranged between the front wall of the at least one reservoir of inputs and the front wall of the at least one containment structure, and further directed to the at least one reservoir of inputs; and at least one input flow existing between the front wall of the at least one reservoir of inputs and the front wall of the at least one containment structure, wherein pressure from the at least one spraying means, when spraying, pushes the at least one input flow from the at least one reservoir of inputs to the front wall of the at least one containment structure via the first gap;

wherein the at least one water spreader provides the at least one spraying means directed towards a second gap arranged between a rear wall of the at least one reservoir of inputs and a rear wall of the at least one containment structure.

2. The system according to claim 1, further comprising at least one flow of inputs existing between the rear wall of the at least one reservoir of inputs and the rear wall of the at least one containment structure.

3. The system according to claim 1, wherein the at least one water spreader provides the at least one spraying means directed towards a third gap arranged between at least one sidewall of the at least one reservoir of inputs and at least one sidewall of the at least one containment structure.

4. The system according to claim 3, further comprising at least one flow of inputs existing between the at least one side-wall of the at least one reservoir of inputs and the at least one sidewall of at least one containment structure.

5. The system according to claim 1, wherein the at least one reservoir of inputs comprises a body independent and configured to be housed inside the perimeter of the at least one containment structure.

6. The system according to claim 5, wherein the at least one reservoir of inputs is configured to be housed inside a compartmentalized recess defined within the perimeter of the at least one containment structure.

7. The system according to claim 1, further comprising at least two simultaneous flows of inputs.

8. The system according to claim 7, wherein at least one of the at least two simultaneous flows of inputs have a flow rate accelerated by water sprayed by the at least one spraying means directed to at least two of the first gap arranged between the front wall of the at least one reservoir of inputs and the front wall of the at least one containment structure, a second gap arranged between a rear wall of the at least one reservoir of inputs and a rear wall of the at least one containment structure, and a third gap arranged between at least one sidewall of the at least one reservoir of inputs and at least one sidewall of the at least one containment structure.

9. A washing machine provided with a system for supplying washing inputs as defined in claim 1, wherein the washing machine comprises a clothes washing machine.

10. A washing machine provided with a system for supplying washing inputs as defined in claim 1, wherein the washing machine comprises a dishwashing machine.

11. A system for supplying washing inputs, comprising:

at least one hydraulic circuit comprising at least one water inlet pipe, at least one reservoir of inputs and at least one inputs outlet pipe;

at least one water spreader associated with the at least one water inlet pipe;

at least one containment structure associated with the at least one inputs outlet pipe, and the at least one reservoir of inputs arranged within a perimeter of the at least one containment structure;

a first gap arranged between a front wall of the at least one reservoir of inputs and a front wall of the at least one containment structure;

at least one spraying means of the at least one water spreader directed to the first gap arranged between the front wall of the at least one reservoir of inputs and the front wall of the at least one containment structure, and further directed to the at least one reservoir of inputs; and at least one input flow existing between the front wall of the at least one reservoir of inputs and the front wall of the at least one containment structure, wherein pressure from the at least one spraying means, when spraying, pushes the at least one input flow from the at least one reservoir of inputs to the front wall of the at least one containment structure via the first gap;

wherein the at least one water spreader provides the at least one spraying means directed towards a third gap arranged between at least one sidewall of the at least one reservoir of inputs and at least one sidewall of the at least one containment structure.

12. The system according to claim 11, further comprising at least one flow of inputs existing between the at least one sidewall of the at least one reservoir of inputs and the at least one sidewall of at least one containment structure.

13. The system according to claim 11, wherein the at least one reservoir of inputs comprises a body independent and configured to be housed inside the perimeter of the at least one containment structure.

14. The system according to claim 13, wherein the at least one reservoir of inputs is configured to be housed inside a compartmentalized recess defined within the perimeter of the at least one containment structure.

15. A system for supplying washing inputs, comprising:

at least one hydraulic circuit comprising at least one water inlet pipe, at least one reservoir of inputs and at least one inputs outlet pipe;

at least one water spreader associated with the at least one water inlet pipe;

at least one containment structure associated with the at least one inputs outlet pipe, and the at least one reservoir of inputs arranged within a perimeter of the at least one containment structure;

a first gap arranged between a front wall of the at least one reservoir of inputs and a front wall of the at least one containment structure;

at least one spraying means of the at least one water spreader directed to the first gap arranged between the front wall of the at least one reservoir of inputs and the front wall of the at least one containment structure, and further directed to the at least one reservoir of inputs; and at least one input flow existing between the front wall of the at least one reservoir of inputs and the front wall of the at least one containment structure, wherein pressure from the at least one spraying means, when spraying, pushes the at least one input flow from the at least one reservoir of inputs to the front wall of the at least one containment structure via the first gap;

further comprising at least two simultaneous flows of inputs;

wherein at least one of the at least two simultaneous flows of inputs have a flow rate accelerated by water sprayed by the at least one spraying means directed to at least two of the first gap arranged between the front wall of the at least one reservoir of inputs and the front wall of the at least one containment structure, a second gap arranged between a rear wall of the at least one reservoir of inputs and a rear wall of the at least one containment structure, and a third gap arranged between at least one sidewall of the at least one reservoir of inputs and at least one sidewall of the at least one containment structure.

16. The system according to claim 15, wherein the at least one water spreader provides the at least one spraying means directed towards a third gap arranged between at least one sidewall of the at least one reservoir of inputs and at least one sidewall of the at least one containment structure.

17. The system according to claim 16, further comprising at least one flow of inputs existing between the at least one sidewall of the at least one reservoir of inputs and the at least one sidewall of at least one containment structure.

18. The system according to claim 15, wherein the at least one reservoir of inputs comprises a body independent and configured to be housed inside the perimeter of the at least one containment structure.

19. The system according to claim 18, wherein the at least one reservoir of inputs is configured to be housed inside a compartmentalized recess defined within the perimeter of the at least one containment structure.

* * * * *